US005549296A

United States Patent [19]

Gilbert

[11] Patent Number: 5,549,296

[45] Date of Patent: Aug. 27, 1996

[54] GOLF CLUB SOLE CONFIGURATION

[75] Inventor: Peter J. Gilbert, Vista, Calif.

[73] Assignee: Acushnet Company, Fairhaven, Mass.

[21] Appl. No.: 402,251

[22] Filed: Mar. 10, 1995

[51] Int. Cl.[6] ..... A63B 53/04

[52] U.S. Cl. ..... 473/290; 473/328

[58] Field of Search ..... 273/167 R, 172, 273/174, 167 A

[56] References Cited

U.S. PATENT DOCUMENTS

| | | | |
|---|---|---|---|
| D. 332,812 | 1/1993 | Solheim . | |
| D. 364,206 | 11/1995 | Schmidt et al. . | |
| 2,705,147 | 3/1955 | Winter | 273/167 A |
| 3,897,065 | 7/1975 | Solheim . | |
| 4,671,513 | 6/1987 | Swanson | 233/172 |
| 4,854,580 | 8/1989 | Kobayashi | 273/167 A |
| 5,301,941 | 4/1994 | Allen . | |
| 5,301,944 | 4/1994 | Koehler . | |
| 5,312,105 | 5/1994 | Cleveland . | |
| 5,423,534 | 6/1995 | Solheim | 273/167 A |

*Primary Examiner*—V. Millin
*Assistant Examiner*—William M. Pierce
*Attorney, Agent, or Firm*—Pennie & Edmonds

[57] ABSTRACT

A golf club or set of golf clubs include a sole having three surfaces: a positive bounce surface, a trailing sole surface and a crescent surface therebetween. The crescent surface has a generally straight front boundary and a curved rear boundary. Moreover, the crescent surface has a bounce angle such that there is a contact point substantially in the center of the rear boundary of the crescent surface.

25 Claims, 2 Drawing Sheets

GOLF CLUB SOLE CONFIGURATION

BACKGROUND OF THE INVENTION

Prior golf clubs have includes a variety of flange or sole configurations. The purpose of the sole is to provide a surface to rest the club against the ground. Thus, the majority of the prior art soles have been flat to correspond to the flat ground.

To avoid substantial digging by the club's leading edge, most prior art clubs include a radius along the leading edge. This avoids a sharp edge that will continue to dig into the ground as the club goes through the ball during impact.

SUMMARY OF THE INVENTION

Broadly, the present invention comprises a golf club having a flange or sole comprising three (3) surfaces: a positive bounce surface; a trailing sole surface and a crescent surface.

The positive bounce surface is a narrow surface adjacent to the lower edge of the club face or striking surface. The positive bounce surface is angled from the ground by a positive bounce angle. Generally, it is preferred that this angle increases for the amount of loft in the club, i.e., the long irons that have little loft should have a smaller positive bounce angle and the short irons that have substantially more loft should have a larger positive bounce angle. Moreover, the width of the positive bounce surface preferably increases in rolation to the amount of loft in the club.

The second surface is the trailing sole surface which is angled from the ground by a relief angle. The relief angle is preferably large enough to allow the club face to be opened without changing the height of the lower edge of the club face.

The third surface is a crescent surface which is located between the positive bounce surface and the trailing sole surface. The crescent surface has two borders; a front border separating the crescent surface from the positive bounce surface and a rear border separating the crescent surface from the trailing sole surface. Preferably, the front border is substantially straight and parallel to the lower edge of the club face and the rear border is curved such that the widest point of the crescent surface is in the center of the club between the toe and heel.

The crescent surface is also angled from the ground by a bounce angle. Again, it is preferred that this angle increase for the amount of loft in the club, i.e., the long irons that have little loft should have small bounce angles and the short irons that have relatively large loft angles should have larger bounce angles. Still further, it is preferred that for each club in a set (generally 3 iron through sand wedge) that the bounce angle either remain equal or increase from the bounce angle of the next higher club (lower club number).

It is a feature that a plurality of clubs in a set of clubs have a flange or sole as set forth above. More particularly, it is a feature of the present invention to have a plurality of clubs designed to provide optimum performance for each club.

It is a further feature of the invention that the leading edge, i.e., the lower edge of the club face, varies in height from the ground throughout a set of irons. The leading edge height is a function of the width of the positive bounce surface and crescent surface and the angles of the positive bounce angle and bounce angle. These dimensions are preferably designed such that the leading edge height progressively increases with club loft within a set.

DESCRIPTION OF THE PREFERRED EMBODIMENT

Figure 1:
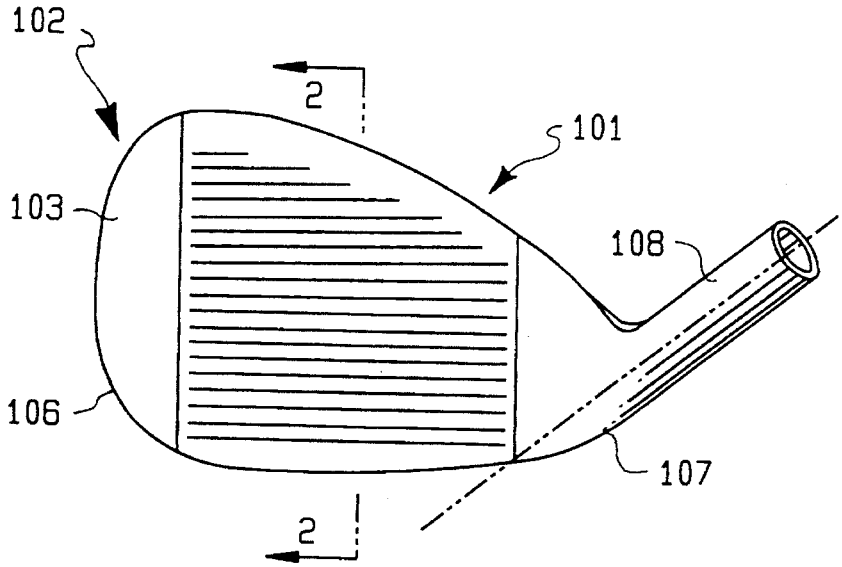
FIG. 1 is a front elevational view of the present inventive golf club head having three (3) sole related surfaces.
Figure 2:
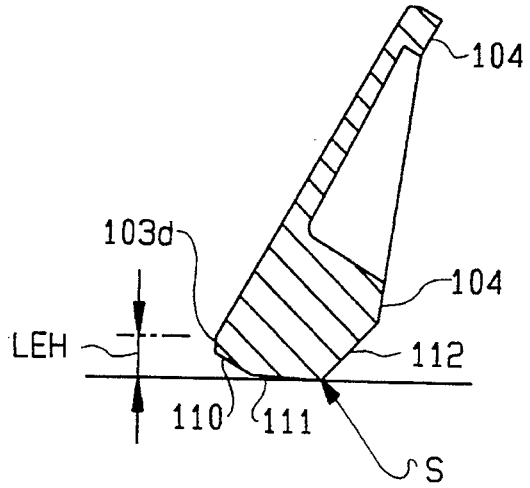
FIG. 2 is a sectional view taken along line 2—2 of FIG. 1.
Figure 3:
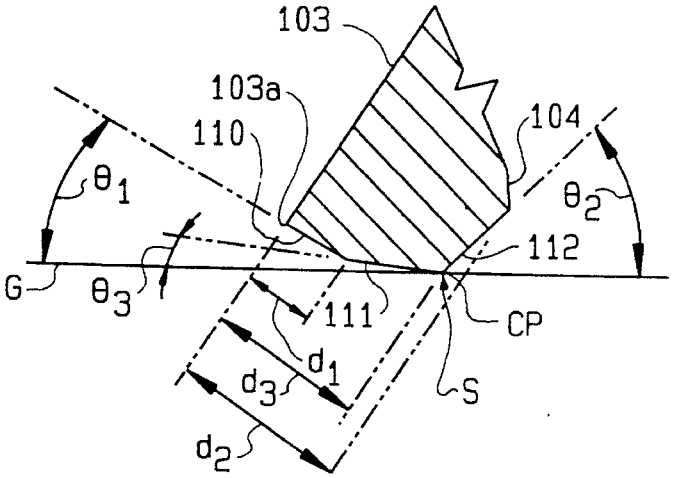
FIG. 3 is an enlarged partial view of FIG. 2 showing the club sole of the present invention resting on the ground.

Referring to FIGS. 1, 2, and 3, a high lofted club such as a 9-iron includes three (3) surfaces on the club flange or sole to accomplish proper engagement of the club with the ground during address and movement of the club head during swinging. Club 101 includes body 102 having striking face 103, a leading edge or lower edge 103*a*, rear face 104, toe 106, heel 107 and hosel 108. The present invention is also useful for all clubs in a set, which generally consists of a three (3) iron through sand wedge, but can be from a one (1) iron through sand wedge and include a lob wedge.

Turning more particularly to FIGS. 2 and 3, sole or flange S of body 102 has three surfaces, first surface 110, second surface 112 and third surface 111 therebetween.

The first surface of sole S is a positive bounce surface 110 that is adjacent the lower edge 103*a* of striking surface 103. First surface 110 has positive bounce angle $\Theta_1$ and extends a distance $d_1$ from the lower edge 103*a*. Preferably, the positive bounce surface extends from the heel 107 to the toe 106 and is relatively narrow, i.e., the width of the surface is between 0.1 and 0.2 inch.

The second surface of sole S is trailing sole surface 112, which is adjacent the rear surface 104 and has a negative relief angle $\Theta_2$. The negative relief angle $\Theta_2$ is designated as a negative angle. Preferably the negative relief angle $\Theta_2$ is greater than about 15 degrees such that the club will not rest on the trailing sole surface 112 during address and the club will not catch the ground during the take away of the club from address during the back swing.

Figure 4:
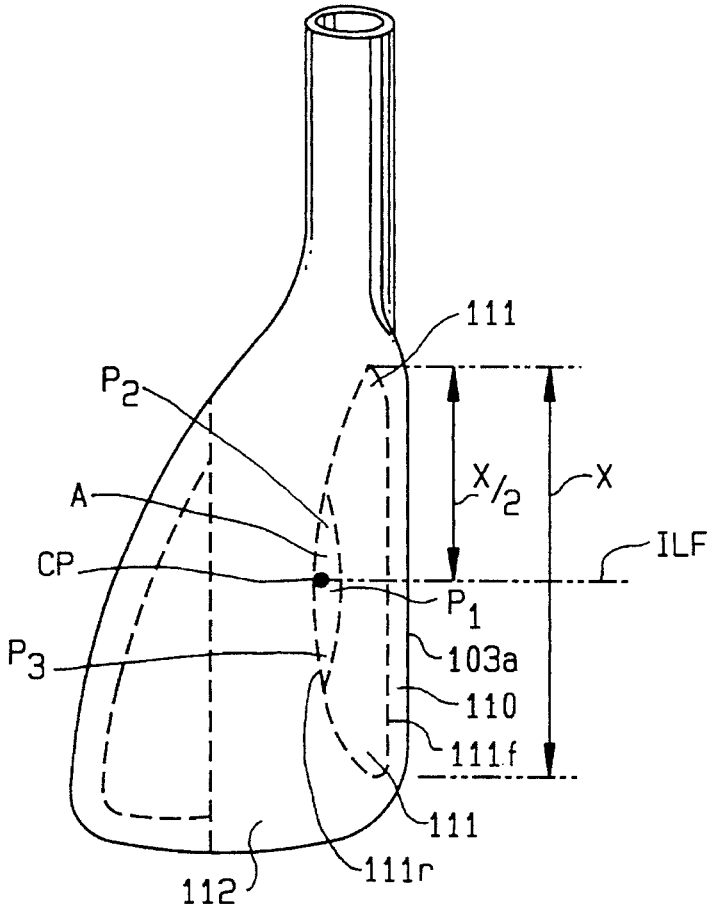
FIG. 4 is a top view of the club head sole, square at address.

The third surface of sole S is crescent surface 111, which has a bounce angle $\Theta_3$ and extends a distance $d_3$ from the center of the lower edge 103*a* to the center of the crescent back edge (shown as CP in FIG. 4). Thus, the crescent surface 111 is between the positive bounce surface 110 and the trailing sole surface 112. Preferably, the bounce angle $\Theta_3$ is relatively small, i.e., about 3 degrees, for low lofted clubs and substantially larger for high lofted clubs.

Also shown in FIG. 2 is the distance dimension from the ground to the leading edge of the club face 103*a* (the leading edge height or LEH). The leading edge height is smaller in irons with the least loft and larger in the more lofted irons. Preferably, the leading edge height is progressively larger within a set as shown in Table I below.

TABLE I

| Iron | LEH | $\theta_1$ | $d_1$ | $\theta_2$ | $d_2$ | $\theta_3$ | $d_3$ |
|---|---|---|---|---|---|---|---|
| 1. | .118 | 20 | .123 | −25 | .695 | 2 | .487 |
| 2. | .125 | 20 | .123 | −25 | .695 | 3 | .487 |
| 3. | .126 | 20 | .123 | −25 | .690 | 3 | .487 |
| 4. | .147 | 25 | .154 | −25 | .685 | 4 | .487 |
| 5. | .148 | 25 | .154 | −25 | .680 | 4 | .487 |
| 6. | .150 | 25 | .154 | −25 | .675 | 5 | .487 |
| 7. | .158 | 25 | .154 | −25 | .665 | 5 | .487 |
| 8. | .164 | 30 | .154 | −21 | .655 | 6 | .487 |
| 9. | .186 | 30 | .154 | −21 | .642 | 8 | .518 |
| PW | .217 | 35 | .165 | −21 | .627 | 10 | .518 |
| W | .263 | 40 | .175 | −21 | .619 | 14 | .538 |
| SW | .328 | 45 | .185 | −18 | .609 | 22 | .548 |
| LW | .306 | 35 | .180 | −18 | .600 | 20 | .520 |

Referring to Table I and FIG. 3, preferably, both the positive bounce angle $\Theta_1$ and the bounce angle $\Theta_3$ progressively increase with the club loft within a set of irons. That is the angles either remain the same or increase from one club to the next going from the low lofted clubs to the high lofted clubs. Similarly, the width of the positive bounce surface 110 and crescent surface 111 should be larger for the high lofted clubs. The larger bounce angles $\Theta_1$ and $\Theta_3$ and the greater widths of the positive bounce surface 110 and crescent surface 111 in the high lofted clubs will help prevent digging with these clubs ("fat" shots), while the small bounce angles $\Theta_1$ and $\Theta_3$ in the low lofted clubs allow the player to strike the golf ball more cleanly.

It will be evident to one skilled in the art that the numbers presented in Table I are merely preferred numbers. Moreover, the bounce angles $\Theta_1$ and $\Theta_3$and surface widths $d_1$ and $d_3$ can be varied for the type of player and the playing conditions. For instance, the bounce angles $\Theta_1$ and $\Theta_3$ and surface widths $d_1$ and $d_3$ should generally be greater for a high handicap player or for playing in wetter, softer conditions. Thus, the club or set of clubs can have customized sole configurations and dimensions for the player and/or the playing conditions.

Figure 4A:
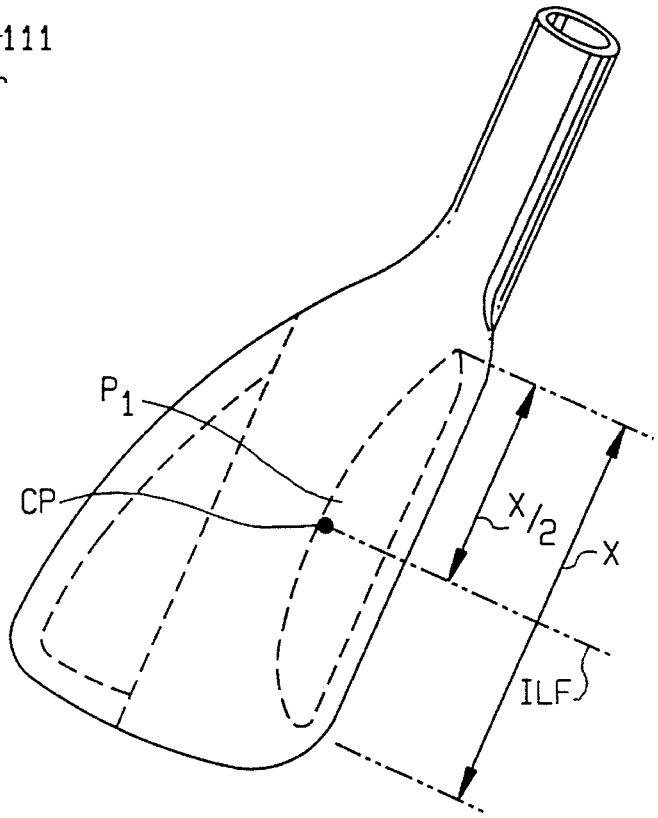
FIG. 4*a* is a top view of the club head sole, open at address.

Turning to FIGS. 4 and 4*a*, crescent surface 111 is defined by substantially straight front border 111*f* and curved rear border 111*r*. Front border 111*f* defines the boundary between positive bounce surface 110 and the crescent surface 111 and is preferably substantially parallel to the leading edge 103*a*. The rear border 111*r* is specifically curved such that the center of the curve forms a contact point CP. When the club head is held and supported by the player, club head body 102 theoretically would touch a smooth plane (ground) at the contact point CP. This point CP is in the center of rear border 111*r* of crescent surface 111, i.e., the length of surface 111 between the heel 107 and toe 106 is a distance X and the contact point CP is at ½X from the heel 107.

Turning to FIG. 4*a*, there is shown crescent surface 111 of this embodiment engaging ground G at point CP and as the club head is moved to an open position. The ground contact point CP remains at the same point CP in the middle of the club head as when the club face is in the square position as in FIG. 4. This greatly increases the versatility of the club head by substantially keeping the contact point in the middle and keeping the leading edge height constant.

Finally, sole S in practice engages uneven or soft ground, including grass, along a club surface area A within crescent surface 111. The pressure exerted by club head 101 against ground G varies with the weight of the club and the player's technique. The pressure in area A of crescent surface 111 of this embodiment of the invention include pressure $P_1$ in the center of A which is larger than pressure $P_2$, $P_3$ at the ends of area A towards the heel 107 and toe 106. The vertical relief in the heel 107 and toe 106 are such that the ground pressure decreases away from the center of contact point CP of the crescent surface. Where the player allows the club body 102 to rest partially supported and readied for swinging, $P_1$ at the contact point CP will be four (4) to five (5) times greater than pressures $P_1$ and $P_3$ that are along the outer edges of the contact area toward the heel 107 and the toe 106. This is accomplished because the angle $\Theta_3$ and curved rear boundary 111 of the crescent surface 111 create a vertical relief in the crescent surface toward heel 107 and the toe 106. Such relief means that the ends of the contact area along the rear border 111*r* are closer to the player or viewer (in FIG. 4) than the center CP of the rear border 111*r* and, thus, do not contact the ground with the same pressure.

I claim;

1. A set of irons wherein each of the irons has a heel, a toe and a striking face having a lower edge therebetween, and in which one or more of the irons has a flange comprising three (3) surfaces:

a) a positive bounce surface which is substantially adjacent to the lower edge of the striking face and has a first positive bounce angle;

b) a trailing sole surface which has a negative relief angle; and c) a crescent shaped surface positioned between the positive bounce surface and the trailing sole surface, wherein the crescent shaped surface and the trailing sole surface form a curved rear border of the crescent shaped surface and the crescent shaped surface and the positive bounce surface form a substantially straight front border of the crescent shaped surface.

2. The set of irons of claim 1 in which the crescent shaped surface has a second positive bounce angle.

3. The set of irons of claim 1 in which the crescent shaped surface has a second positive bounce angle, whereby the lowest point of the iron is on the rear border and the crescent shaped surface provides vertical relief toward the heel and toe from the lowest point such that ground pressure during address decreases away from the lowest point.

4. The set of irons of claim 3 wherein the second positive bounce angle of an iron of the set is equal to or greater than the second positive bounce angle for the next iron in the set with less loft.

5. The set of irons of claim 4 wherein the second positive bounce angle is between about 2 and 22 degrees.

6. The set of irons of claim 1 in which an iron in the set has a leading edge height greater than another iron in the set.

7. The set of irons of claim 6 in which the leading edge height progressively increases with the loft of the iron though the set of irons.

8. The set of irons of claim 1 wherein the first positive bounce angle of an iron of the set is equal to or greater than the first positive bounce angle for the next iron in the set with less loft.

9. The set of irons of claim 8 wherein the first positive bounce angle is between about 20 and 45 degrees.

10. A golf club iron comprised of a heel, toe, a striking face with a leading edge between the heel and toe, and a flange comprised of three (3) surfaces:

a) a positive bounce surface;

b) a crescent shaped surface; and c) a trailing sole surface, wherein said crescent shaped surface is positioned between said positive bounce surface and said trailing sole surface thereby forming a curved rear border between the crescent surface and the trailing sole surface and said crescent shaped surface has a first positive bounce angle such that the iron's lowest point is on the curved rear border.

11. The golf club iron of claim 10 wherein the crescent surface includes a substantially straight front border separating the positive bounce surface and the crescent surface that is substantially parallel to the leading edge.

12. The golf club iron of claim 11 wherein the lowest point of the iron is approximately half the distance between the club heel and toe.

13. The golf club iron of claim 10 in which the positive bounce surface has a width between about 0.1 and 0.2 inches and has a second positive bounce angle.

14. The golf club iron of claim 13 wherein the second positive bounce angle is between about 20 and 45 degrees.

15. The golf club iron of claim 10 in which the trailing sole surface has a negative relief angle.

16. The golf club iron of claim 10 wherein the first positive bounce angle is between about 2 and 22 degrees.

17. A golf club iron comprised of a heel, a toe, a striking face with a leading edge between the heel and toe, and a flange having three surfaces including:

a) a positive bounce surface adjacent to the leading edge and having a first positive bounce angle;

b) a substantially flat crescent shaped surface having a second positive bounce angle; and c) a trailing sole surface having a negative relief angle, wherein said crescent shaped surface is positioned between said positive bounce surface and said trailing sole surface thereby forming a curved rear border between the crescent surface and the trailing sole surface and a substantially straight front border between the positive bounce surface and the crescent shaped surface.

18. The golf club iron of claim 17 wherein the front border separating the positive bounce surface and the crescent surface is substantially parallel to the leading edge.

19. The golf club iron of claim 18 wherein the lowest point of the iron is on the rear border and approximately half the distance between the club heel and toe.

20. The golf club iron of claim 17 in which the positive bounce surface extends from the heel to the toe and extends a distance from the leading edge of between about 0.1 and 0.2 inches.

21. The golf club iron of claim 20 wherein the first positive bounce angle is about 45 degrees or less.

22. The golf club iron of claim 20 wherein the first positive bounce angle is between about 20 and 45 degrees.

23. The golf club iron of claim 17 wherein the second positive bounce angle is about 22 degrees or less.

24. The golf club iron of claim 17 wherein the second positive bounce angle is between about 2 and 22 degrees.

25. The golf club iron of claim 17 wherein the distance from the leading edge of the iron to the lowest point on the iron is between about 0.487 to 0.52 inches.

* * * * *